US010053910B2

(12) United States Patent
Avinger

(10) Patent No.: US 10,053,910 B2
(45) Date of Patent: Aug. 21, 2018

(54) MULTI-DECORATIVE COVER FOR VERTICAL WINDOW BLINDS

(71) Applicant: LaVonne Avinger, Richton Park, IL (US)

(72) Inventor: LaVonne Avinger, Richton Park, IL (US)

( * ) Notice: Subject to any disclaimer, the term of this patent is extended or adjusted under 35 U.S.C. 154(b) by 140 days.

(21) Appl. No.: 15/094,736

(22) Filed: Apr. 8, 2016

(65) Prior Publication Data

US 2016/0298386 A1 Oct. 13, 2016

Related U.S. Application Data

(60) Provisional application No. 62/145,622, filed on Apr. 10, 2015.

(51) Int. Cl.
*E06B 9/36* (2006.01)
*E06B 9/386* (2006.01)

(52) U.S. Cl.
CPC ..... *E06B 9/386* (2013.01); *E06B 9/36* (2013.01)

(58) Field of Classification Search
CPC ..... E06B 9/36; E06B 9/386
USPC ..... 160/168.1 V, 167 V, 236
See application file for complete search history.

(56) References Cited

U.S. PATENT DOCUMENTS 2,074,482 A * 3/1937 Martens ..... E06B 9/386 156/65
2,169,873 A * 8/1939 Clark, Jr. ..... E06B 9/386 160/178.1 R
3,851,699 A * 12/1974 Shapiro ..... A47H 23/04 160/168.1 V
4,049,038 A * 9/1977 Hyman ..... E06B 9/386 160/166.1
4,069,526 A * 1/1978 Deikel ..... A47C 21/022 5/486
4,434,834 A * 3/1984 Ennes ..... E06B 9/386 160/166.1
4,519,435 A * 5/1985 Stier ..... E06B 9/386 160/168.1 V
4,773,958 A * 9/1988 Goodman ..... E06B 9/386 156/176
4,842,036 A * 6/1989 Goodman ..... E06B 9/36 160/166.1

(Continued)

FOREIGN PATENT DOCUMENTS

EP 1146198 A3 * 4/2003 ..... E06B 9/28

*Primary Examiner* — Katherine W Mitchell
*Assistant Examiner* — Johnnie A. Shablack
(74) *Attorney, Agent, or Firm* — Faegre Baker Daniels LLP

(57) ABSTRACT

A removable multi-decorative cover for a vertical window blind is disclosed. The cover includes a first portion having a first top portion and a first bottom portion seamed to each other along a first bottom edge, a first left edge, and a first right edge. The first portion is shaped substantially as a sleeve to enclose the vertical blind. The cover includes a second portion having a second top portion and a second bottom portion seamed to each other along a second top edge, a second bottom edge, a second left edge, and a second right edge. The second portion may be seamed to the first left edge or the first right edge of the first portion along the second left edge or the second right edge. The second portion may be configured to fold over the first portion along the first left edge or the first right edge.

17 Claims, 5 Drawing Sheets

(56) References Cited

U.S. PATENT DOCUMENTS 4,911,220 A * 3/1990 Hiller ..... E06B 9/386 160/236
4,930,562 A * 6/1990 Goodman ..... A47H 2/00 160/236
5,050,662 A * 9/1991 Kellener ..... E06B 9/386 160/168.1 V
5,094,286 A * 3/1992 Hansen ..... E06B 9/386 160/168.1 V
5,101,876 A * 4/1992 Zak ..... E06B 9/386 160/178.1 R
5,105,870 A * 4/1992 Merjane ..... E06B 9/386 160/236
5,141,042 A * 8/1992 Schwaegerle ..... E06B 9/386 160/236
5,191,922 A * 3/1993 Wade ..... A47H 13/00 160/124
5,263,529 A * 11/1993 Landis ..... B44C 1/1733 160/236
5,271,447 A * 12/1993 Aronovich ..... E06B 9/386 160/236
5,297,607 A * 3/1994 Beauchamp ..... E06B 9/367 160/84.04
5,303,760 A * 4/1994 Perez ..... E06B 9/368 160/236
5,358,024 A * 10/1994 Schwaegerle ..... E06B 9/386 160/236
5,394,925 A * 3/1995 Ives ..... E06B 9/386 160/236
5,495,628 A * 3/1996 Logan ..... A47K 3/38 160/330
5,572,831 A * 11/1996 Rafiqui ..... E06B 9/386 160/236
5,601,132 A * 2/1997 Goodman ..... E06B 9/36 160/173 V
5,603,369 A * 2/1997 Colson ..... E06B 9/262 160/166.1
5,655,589 A * 8/1997 Vartanian ..... E06B 9/386 160/166.1
5,664,269 A * 9/1997 Broder ..... A47G 9/0207 5/482
5,715,883 A * 2/1998 Keith ..... E06B 9/36 160/330
5,718,273 A * 2/1998 Best ..... E06B 9/303 160/166.1
5,775,399 A * 7/1998 Shields, Jr. ..... E06B 9/386 160/176.1 R
5,887,299 A * 3/1999 Phillips ..... A47G 9/0207 5/413 R
5,937,927 A * 8/1999 Keith ..... E06B 9/36 160/168.1 R
6,079,947 A * 6/2000 Gabriel ..... F04D 25/088 416/146 R
6,125,906 A * 10/2000 Kotin ..... B44F 1/00 160/236
D436,783 S * 1/2001 Cooper ..... D6/575
6,186,213 B1 * 2/2001 Senesac ..... E06B 9/36 160/84.04
6,192,961 B1 * 2/2001 Martinez ..... A47H 23/04 160/178.1 R
6,237,171 B1 * 5/2001 Allen ..... A47G 9/0207 5/482
6,334,477 B1 * 1/2002 Moir ..... E06B 9/264 160/168.1 V
6,510,806 B1 * 1/2003 Krieck ..... E06B 9/36 112/475.08
6,510,885 B1 * 1/2003 Shih ..... E06B 9/262 160/236
6,598,650 B1 * 7/2003 Palmer ..... B29C 53/52 160/236
6,675,858 B2 * 1/2004 Marocco ..... A47H 23/06 160/168.1 V
6,688,373 B2 * 2/2004 Corey ..... E06B 9/28 160/236
6,718,579 B1 * 4/2004 Greenstein ..... A47G 9/0207 5/482
6,786,269 B2 * 9/2004 Senesac ..... E06B 9/262 160/168.1 V
6,789,596 B1 * 9/2004 Lin ..... E06B 9/264 160/168.1 V
6,866,082 B1 * 3/2005 Zahner ..... A47K 3/38 160/390
7,011,499 B2 * 3/2006 Tomlin ..... F04D 25/088 150/154
7,100,666 B2 * 9/2006 Colson ..... B29C 53/04 160/173 R
7,163,043 B2 * 1/2007 Huang ..... E06B 9/264 160/84.04
7,165,594 B2 * 1/2007 Senesac ..... E06B 9/262 160/178.1 V
7,989,046 B2 * 8/2011 DiNunzio ..... A47H 23/10 160/237
8,025,481 B2 * 9/2011 Foxworth ..... F04D 29/005 416/62
9,113,739 B2 * 8/2015 Thomas ..... A47H 2/00
9,135,841 B2 * 9/2015 Ayad ..... G09F 11/02
9,140,061 B2 * 9/2015 Cha ..... E06B 9/36
9,144,340 B2 * 9/2015 Mayer ..... A47H 23/00
2003/0034134 A1 * 2/2003 Saralou ..... E06B 9/262 160/236
2003/0051823 A1 * 3/2003 Nien ..... A47H 23/06 160/89
2003/0213567 A1 * 11/2003 Markley ..... E06B 9/386 160/236
2005/0211392 A1 * 9/2005 Elembaby ..... A47H 23/04 160/89
2006/0118249 A1 * 6/2006 Huang ..... E06B 9/264 160/89
2006/0237147 A1 * 10/2006 Strand ..... E06B 9/264 160/89
2007/0006979 A1 * 1/2007 Hsu ..... E06B 9/262 160/89
2007/0056693 A1 * 3/2007 Szebeni ..... E06B 9/36 160/168.1 V
2007/0240835 A1 * 10/2007 Chen ..... E06B 9/386 160/236
2007/0267153 A1 * 11/2007 Hardy ..... E06B 9/262 160/168.1 V
2008/0142170 A1 * 6/2008 Killian ..... E06B 9/36 160/236
2009/0032199 A1 * 2/2009 Woods ..... E06B 9/36 160/34
2009/0044888 A1 * 2/2009 Ganey ..... A47H 21/00 150/154
2009/0139664 A1 * 6/2009 Graichen ..... E06B 9/36 160/84.04
2010/0186904 A1 * 7/2010 Merritt ..... E06B 9/36 160/89
2012/0255476 A1 * 10/2012 Walker ..... E06B 9/386 112/407
2012/0261083 A1 * 10/2012 Daly ..... A47H 23/02 160/236
2015/0327706 A1 * 11/2015 Harter ..... A47H 21/00 160/126
2015/0374160 A1 * 12/2015 Mayer ..... A47H 23/00 160/237
2016/0298386 A1 * 10/2016 Avinger ..... E06B 9/386

* cited by examiner

MULTI-DECORATIVE COVER FOR VERTICAL WINDOW BLINDS

This application claims the benefit of U.S. Provisional Application No. 62/145,622, filed Apr. 10, 2015.

FIELD OF THE DISCLOSURE

The disclosure relates generally to a cover, and more particularly, a multi-decorative cover for vertical window blinds.

BACKGROUND

Vertical window blinds have been utilized in millions of homes for decades and are usually manufactured from plastic, fabric, metal, or wood. Although blinds were created to cover windows and openings, blinds also provide a decorative appearance to the window. However, once a set of vertical window blinds have been installed, their appearance is not changeable unless the blinds are replaced, or by covering each vane. Some vertical window blinds have inserts that provide a different appearance on each side of the vane. However, beyond the two sides, there is limited variation. Some patents have been issued on products that cover the vanes. Exemplary examples of these patents are described herein.

U.S. Pat. No. 4,911,220 discloses a replaceable decorative louver covering system. The louver covers are pre-printed where each cover has a pre-printed pattern that is visible where the collective group of covers is installed over all the louvers. While these covers provide the basic function of covering a vertical blind, they do not provide the ability to quickly change the appearance of the vertical blind without replacing the cover or the blinds themselves.

U.S. Pat. No. 5,303,760 discloses a blind covering apparatus and method for changing decor on vertical window blinds. This patent provides a covering of vertical window blinds and further provides for decoding information to ensure that the installer places each blind cover in the correct order on the blinds. While this patent provides a covering for window blinds, the covering does not provide the ability to quickly change the appearance of the vertical blind without replacing the cover or the blinds themselves.

U.S. Pat. No. 6,510,806 discloses a covering for blinds, where the covering is formed as a sleeve that is drawn over the louver or as a flat sheet that is folded over the blind. These covers do not provide the ability to quickly change the appearance of the vertical blind without replacing the cover or the blinds themselves.

Accordingly, what is needed is a removable multi-decorative cover for vertical window blinds to provide versatile window blind covering that can transform and change the appearance of the vertical blinds multiple times without replacing the cover or the blinds themselves. Particularly, what is needed is a removable multi-decorative cover for vertical window blinds that provides a feasible solution for quickly changing the designs, colors, or appearance of vertical window blinds without replacing the blinds or changing the cover.

SUMMARY

In illustrative embodiments, a removable multi-decorative cover for covering a vertical window blind is disclosed. The removable multi-decorative cover includes a first portion and a second portion. The first portion and the second portion may be formed with different fabric patterns. The first portion may include a first top portion and a first bottom portion seamed to each other along a first bottom edge, a first left edge, and a first right edge. The first portion may be shaped substantially as a sleeve to enclose the vertical window blind. The second portion may include a second top portion and a second bottom portion seamed to each other along a second top edge, a second bottom edge, a second left edge, and a second right edge. The second portion may be seamed to either the first left edge or the first right edge of the first portion along either the second left edge or the second right edge of the second portion. The second portion may be configured to fold over the first portion along the first left edge or the first right edge of the first portion. Alternatively, the second portion may be seamed along a substantially center longitudinal axis of the first top portion, and configured to fold over a portion of the first portion along the substantially center axis. The second portion may also be configured to be fastened to the first portion by a first fastener, which may be a magnet, a button, a zipper, a clip, Velcro®, or any other suitable fastener or combination of suitable fasteners.

A second fastener may be attached adjacent to a first top edge of the first portion to securely enclose the vertical window blind in the first portion. The second fastener may also be a magnet, a button, a zipper, a clip, Velcro®, or any other suitable fastener or combination of suitable fasteners.

The removable multi-decorative cover may also include a third portion that includes a third top portion and a third bottom portion. The third top portion and the third bottom portion may be seamed to each other along a third top edge, a third bottom edge, a third left edge, and a third right edge. The third portion may be seamed to the first portion and the second portion along the third left edge or the third right edge of the third portion.

Among other advantages, the removable multi-decorative cover may provide the ability to quickly change the appearance of the vertical blind without replacing the cover or the blinds themselves. The removable multi-decorative cover may be removed and applied to the blinds safely and efficiently. The multi-decorative cover may be configured with multiple decorative fabrics to reveal different decorative patterns when in use. Applying the removable multi-decorative cover on each vertical blind or vane may represent a complete pattern when arranged in a particular sequence. The multi-decorative cover may be configured with removable or fixed fasteners, such as clamps, to secure the second portion on the first portion. Fasteners may also securely attach each multi-decorative cover to each blind or vane.

BRIEF DESCRIPTION OF THE DRAWINGS

The embodiments will be more readily understood in view of the following description when accompanied by the below figures and wherein like reference numerals represent like elements.

DETAILED DESCRIPTION OF THE PREFERRED EMBODIMENTS

Figure 1:
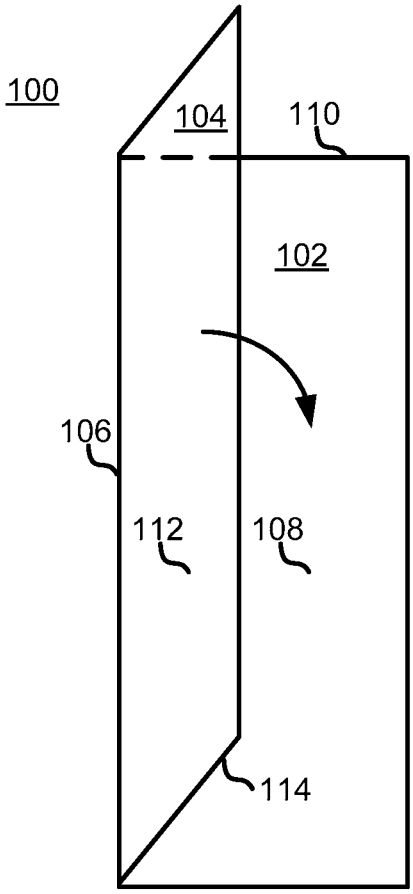
FIG. 1 is a perspective view illustrating an example of a removable multi-decorative cover for vertical window blinds in accordance with one embodiment.

While this invention is susceptible of embodiments in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

FIG. 1 is a perspective view illustrating an example of a removable multi-decorative cover 100 for vertical window blinds in accordance with one embodiment. The removable multi-decorative cover 100 includes a first portion 102 and a second portion 104. The first portion 102 and the second portion 104 may be formed with fabric, plastic, or any other suitable materials to provide more than one decorative cover. The suitable materials may also contain a decorative pattern. The first portion 102 may include a first top portion 108 and a first bottom portion 110 seamed to each other. For example, the first top portion 108 and the first bottom portion 110 may be seamed to each other along one or more edges of the first top portion 108. The first portion 102 may be shaped substantially as a sleeve to enclose the vertical window blind. For example, the first top portion 108 and the first bottom portion 110 of the first portion 102 may be seamed to each other along two or more edges of the first portion 102 (e.g., along three edges) so as to form a sleeve that may enclose a vertical window blind.

The second portion 104 may include a second top portion 112 and a second bottom portion 114 seamed to each other. For example, the second top portion 112 and the second bottom portion 114 may be seamed to each other along one or more edges of the second top portion 112. The second portion 104 may be seamed to an edge 106 of the first portion 102, such that the second portion 104 is configured to fold over the first portion 102 along the edge 106. The second portion 104 may also be configured to be fastened to the first portion 102 by a first fastener described in FIG. 3. The first fastener may be a magnet, a button, a zipper, a clip, Velcro®, or any other suitable fastener or combination of suitable fasteners.

Figure 2:
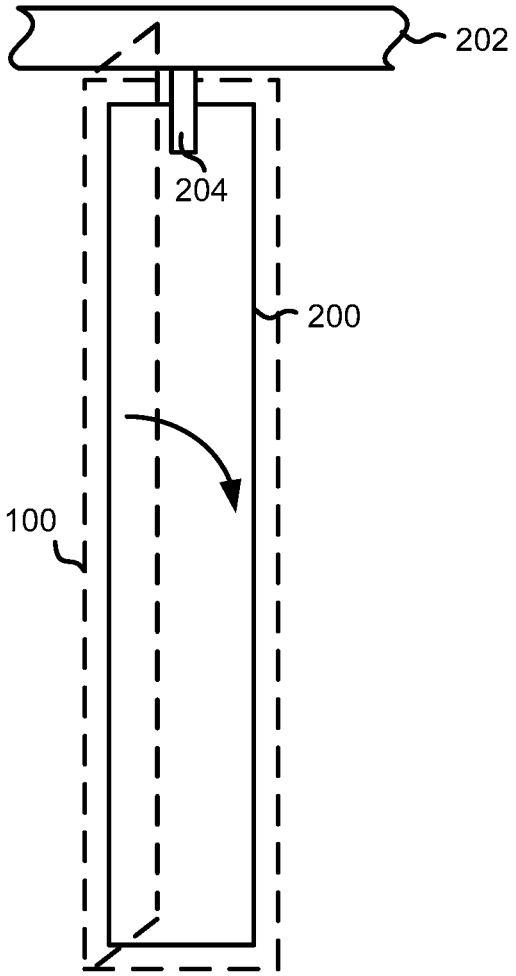
FIG. 2 is a perspective view illustrating a removable multi-decorative cover placed on a vertical blind in accordance with one embodiment.

FIG. 2 is a perspective view illustrating a removable multi-decorative cover 100 placed on a vertical blind 200 in accordance with one embodiment. The removable multi-decorative cover 100, shown in dotted lines, may cover the vertical blind 200 by sliding the cover 100 from the bottom of the vertical blind 200 towards a clip 204 holding the vertical blind on bar support 202. The bar support 202 may be any head rail or suitable bar support that holds the vertical blind as known in the art, and clip 204 may be any fastener that supports the vertical blind on bar support 202 as known in the art. The multi-decorative cover 100 may be securely fastened onto the vertical blind 200, as described further with respect to FIG. 3.

Figure 3:
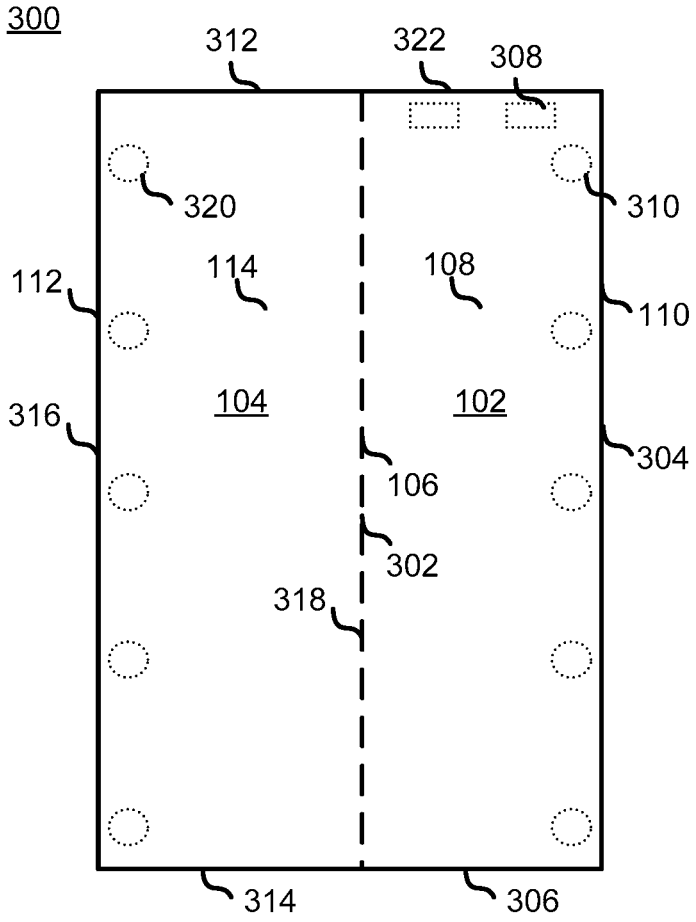
FIG. 3 is an expanded view illustrating another example of a removable multi-decorative cover for vertical window blinds in accordance with one embodiment.

FIG. 3 is an expanded view illustrating another example of a removable multi-decorative cover 300 for vertical window blinds in accordance with one embodiment. As in FIG. 1, the removable multi-decorative cover 300 includes a first portion 102 and a second portion 104. The first portion 102 and the second portion 104 may be formed with different fabric patterns to provide decorative covers with multiple designs. The first portion 102 may include a first top portion 108 and a first bottom portion 110 seamed to each other along a first left edge 302, a first right edge 304, and a first bottom edge 306. The first portion 102 may be shaped substantially as a sleeve to enclose a vertical window blind.

The second portion 104 may include a second top portion 112 and a second bottom portion 114 seamed to each other along a second top edge 312, a second bottom edge 314, a second left edge 316, and a second right edge 318. The second portion 104 may be seamed to either the first left edge 302 or the first right edge 304 of the first portion 102 along either the second left edge 316 or the second right edge 318 of second portion 104. The edge 106 of FIG. 1 is representative of either the first left edge 302 or the first right edge 304 of the first portion 102. If the second portion 104 is seamed to the first left edge 302 of the first portion 102, the removable multi-decorative cover 300 provides the ability to quickly change the appearance of the first portion 102 by flipping the second portion 104 along the second right edge 318 from left to right to reveal a different front decorative surface. If the second portion 104 is seamed to the first right edge 304 of first portion 102, the removable multi-decorative cover 300 provides the ability to quickly change the appearance of the first portion 102 by flipping the second portion 104 along the second right edge 318 of second portion 104 from right to left to reveal a different front decorative surface.

The second portion 104 may also be configured to be fastened to the first portion 102 by at least one first fastener 320, which may be a magnet, a button, a zipper, a clip, Velcro®, or any other suitable fastener or combination of suitable fasteners. The at least one first fastener 320 may either be attached to the second portion 104 on the second bottom portion 114 of second portion 104 or between the second top portion 112 and the second bottom portion 114 of second portion 104. In one embodiment, one first fastener 320 is attached to the second portion 104 on the second bottom portion 114 of second portion 104, and another fastener (e.g., a second fastener) is attached between the second top portion 112 and the second bottom portion 114 of second portion 104.

Additional corresponding fastener(s) 310 may be attached to the first portion 102. Specifically, additional corresponding fastener(s) 310 may be attached either on the first top portion 108 or between the first top portion 108 and the first bottom portion 110, or both. The additional corresponding fastener(s) may be a magnet, a button, a zipper, a clip, Velcro®, or any other suitable fastener or combination of suitable fasteners. For example, if the at least one first fastener 320 is a magnet with a polarity, the additional corresponding fastener(s) 310 may be a magnet with an opposite polarity. As another example, if the at least one first fastener 320 is a button, the additional corresponding fastener(s) 320 may be a slit that receives the button.

A second fastener 308 may be attached adjacent to a first top edge 322 of the first portion 102 to securely enclose the vertical window blind in the first portion 102. Specifically, the second fastener 308 may be attached on the inner surfaces of both the first top portion 108 and the first bottom portion 110. The second fastener 308 may also be a magnet, a button, a zipper, a clip, Velcro®, or any other suitable fastener or combination of suitable fasteners.

Figure 4:
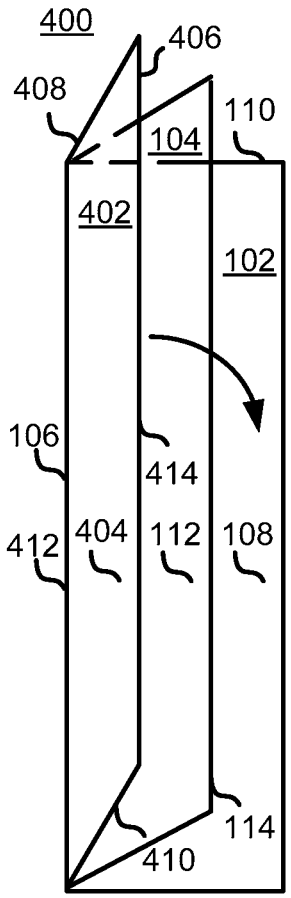
FIG. 4 is a perspective view illustrating another example of a removable multi-decorative cover for vertical window blinds in accordance with one embodiment.

FIG. 4 is a perspective view illustrating another example of a removable multi-decorative cover 400 for vertical window blinds in accordance with one embodiment. The removable multi-decorative cover 400 may include at least a third portion 402 that includes a third top portion 404 and a third bottom portion 406. The third top portion 404 and the third bottom portion 406 may be seamed to each other along a third top edge 408, a third bottom edge 410, a third left edge 412, and a third right edge 414. The third portion 402 may be seamed to the first portion 102 and the second portion 104 along the third left edge 412 or the third right edge 414 of third portion 402. Both the third left edge 412 and the third right edge 414 of third portion 402 are representative of a common edge between the first portion 102 and the second portion 104, such as the edge 106 of FIG. 1. The at least third portion 402, which may have a different pattern than both the first portion 102 and the second portion 104, provides yet another design, color, or appearance without replacing the blinds or changing the cover.

Figure 5:
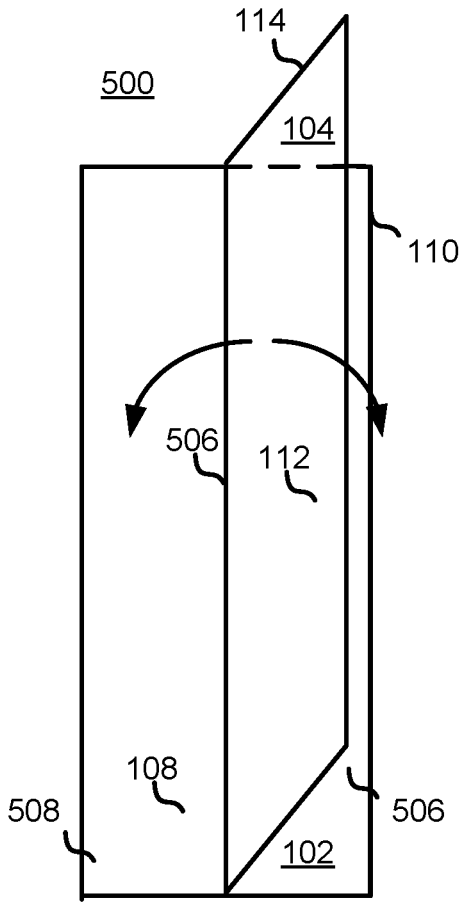
FIG. 5 is a perspective view illustrating another example of a removable multi-decorative cover for vertical window blinds in accordance with one embodiment.

FIG. 5 is a perspective view illustrating an example of a removable multi-decorative cover 500 for vertical window blinds in accordance with one embodiment. Similar to FIG. 1, the removable multi-decorative cover 500 includes a first portion 102 and a second portion 104. The first portion 102 and the second portion 104 may be formed with different fabric patterns to provide more than one decorative cover. The first portion 102 may include a first top portion 108 and a first bottom portion 110 seamed to each other. For example, the first top portion 108 and the first bottom portion 110 may be seamed to each other along one or more edges of the first top portion 108. The first portion 102 may be shaped substantially as a sleeve to enclose the vertical window blind. For example, the first top portion 108 and the first bottom portion 110 of the first portion 102 may be seamed to each other along two or more edges of the first portion 102 (e.g., along three edges) so as to form a sleeve that may enclose a vertical window blind.

The second portion 104 may include a second top portion 112 and a second bottom portion 114 seamed to each other. For example, the second top portion 112 and the second bottom portion 114 may be seamed to each other along one or more edges of the second top portion 112. The second portion 104 may be seamed to an edge 506 of the first portion 102, such that the second portion 104 is configured to fold over a portion (e.g., half) of the first portion 102 along the edge 506. In contrast to edge 106 of FIG. 1 that is representative of either the first left edge 302 or the first right edge 304 of the first portion 102 as shown in FIG. 3, in one embodiment edge 506 is representative of a substantially center longitudinal axis of the first top portion 108 where the second portion 104 is configured to fold over a portion of the first portion 102 along the substantially center longitudinal axis. In other embodiments, edge 506 may be located along any longitudinal axis of the first top portion 108. The second portion may fold over the right portion 506 or the left portion 508 of the first portion 102. The removable multi-decorative cover 500 provides the ability to quickly change the appearance of the first portion 102 by flipping the second portion 104 along the edge 506 from left to right or right to left to reveal a different front decorative surface.

The second portion 104 may also be configured to be fastened to the first portion 102 by a first fastener as described with respect to FIG. 3. The first fastener may be a magnet, a button, a zipper, a clip, Velcro®, or any other suitable fastener or combination of suitable fasteners.

The removable multi-decorative cover described in the embodiments above provide the ability to quickly change the appearance of a first portion by flipping a second portion along an edge from right to left or left to right to reveal a different decorative cover without replacing the cover or the blinds themselves.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A cover for covering a vertical window blind, the cover comprising:

a first portion including a first top portion and a first bottom portion seamed to each other along a first bottom edge, a first left edge, and a first right edge of the first portion, the first portion shaped substantially as a sleeve to enclose the vertical window blind;

a second portion including a second top portion and a second bottom portion seamed to each other along a second top edge, a second bottom edge, a second left edge, and a second right edge of the second portion, the second portion seamed to one of the first left edge or the first right edge of the first portion along one of the second left edge or the second right edge, the second portion configured to fold over the first portion along the one of the first left edge or the first right edge, wherein, the first portion has a different decorative pattern than the second portion.

2. The cover of claim 1, wherein the second portion is configured to be fastened to the first portion by at least one first fastener.

3. The cover of claim 2, wherein the at least one first fastener comprises at least one of a magnet, a button, a zipper, a clip, and Velcro®.

4. The cover of claim 1, wherein at least one second fastener is attached adjacent to a first top edge of the first portion to securely enclose the vertical window blind in the first portion.

5. The cover of claim 4, wherein the at least one second fastener comprises at least one of a magnet, a button, a zipper, a clip, and Velcro®.

6. The cover of claim 1, further comprising:

at least a third portion including a third top portion and a third bottom portion seamed to each other along a third top edge, a third bottom edge, a third left edge, and a third right edge of the third portion, the third portion seamed to the first portion and the second portion along one of the third left edge or the third right edge.

7. An apparatus comprising:

a plurality of vertical blinds;

a plurality of covers for covering the plurality of vertical blinds, each cover comprising:

a first portion including a first top portion and a first bottom portion seamed to each other along a first bottom edge, a first left edge, and a first right edge of the first portion, the first portion shaped substantially as a sleeve to enclose the vertical window blind;

a second portion including a second top portion and a second bottom portion seamed to each other along a second top edge, a second bottom edge, a second left edge, and a second right edge of the second portion, the second portion seamed to one of the first left edge or the first right edge of the first portion along one of the second left edge or the second right edge, the second portion configured to fold over the first portion along the one or the first left edge and the first right edge, wherein, the first portion has a different decorative pattern than the second portion.

8. The apparatus of claim 7, wherein the second portion is configured to be fastened to the first portion by at least one first fastener.

9. The cover of claim 8, wherein the at least one first fastener comprises at least one of a magnet, a button, a zipper, a clip, and Velcro®.

10. The cover of claim 7, wherein at least one second fastener is attached adjacent to a first top edge of the first portion to securely enclose the vertical window blind in the first portion.

11. The cover of claim 10, wherein the at least one second fastener comprises at least one of a magnet, a button, a zipper, a clip, and Velcro®.

12. The cover of claim 7, further comprising:

at least a third portion including a third top portion and a third bottom portion seamed to each other along a third top edge, a third bottom edge, a third left edge, and a third right edge of the third portion, the third portion seamed to the first portion and the second portion along one of the third left edge or the third right edge.

13. A cover for covering a vertical window blind, the cover comprising:

a first portion including a first top portion and a first bottom portion seamed to each other along a first bottom edge, a first left edge, and a first right edge of the first portion, the first portion shaped substantially as a sleeve to enclose the vertical window blind;

a second portion including a second top portion and a second bottom portion seamed to each other along a second top edge, a second bottom edge, a second left edge, and a second right edge of the second portion, the second portion seamed along a substantially center longitudinal axis of the first top portion, the second portion configured to fold over a portion of the first portion along the substantially center axis, wherein, the first portion has a different decorative pattern than the second portion.

14. The cover of claim 13, wherein the second portion is configured to be fastened to the first portion by at least one first fastener.

15. The cover of claim 14, wherein the at least one first fastener comprises at least one of a magnet, a button, a zipper, a clip, and Velcro®.

16. The cover of claim 13, wherein at least one second fastener is attached adjacent to a first top edge of the first portion to securely enclose the vertical window blind in the first portion.

17. The cover of claim 16, wherein the at least one second fastener comprises at least one of a magnet, a button, a zipper, a clip, and Velcro®.

* * * * *